US007207360B2

(12) United States Patent
Vargas

(10) Patent No.: US 7,207,360 B2
(45) Date of Patent: Apr. 24, 2007

(54) CONTAINER AND COUPLING SYSTEM FOR TRANSFERRING GARANULAR AND OTHER MATERIALS

(76) Inventor: Edgar Hidalgo Vargas, Santo Barbara de Heredia Cien metros al sur del Parque, San Jose (CR) 38-1150

( * ) Notice: Subject to any disclaimer, the term of this patent is extended or adjusted under 35 U.S.C. 154(b) by 149 days.

(21) Appl. No.: 10/517,406

(22) PCT Filed: Jun. 6, 2002

(86) PCT No.: PCT/CR02/00004

§ 371 (c)(1),
(2), (4) Date: Dec. 6, 2004

(87) PCT Pub. No.: WO03/103388

PCT Pub. Date: Dec. 18, 2003

(65) Prior Publication Data

US 2005/0217755 A1 Oct. 6, 2005

(51) Int. Cl.
*B65B 1/04* (2006.01)

(52) U.S. Cl. ..... 141/322; 141/284; 141/319; 141/363; 141/366

(58) Field of Classification Search ..... 141/18, 141/100, 102, 105, 106, 113, 267, 268, 284, 141/301, 319, 322, 363–366; 222/526–532, 222/160, 166

See application file for complete search history.

(56) References Cited

U.S. PATENT DOCUMENTS 3,446,403 A * 5/1969 Serio et al. ..... 222/158
4,105,142 A * 8/1978 Morris, Jr. ..... 222/158
4,356,848 A * 11/1982 Spies ..... 141/349

* cited by examiner

*Primary Examiner*—Timothy L. Maust
(74) *Attorney, Agent, or Firm*—Sanchelima & Assoc, P.A.

(57) ABSTRACT

A hermetic container and coupling system for transferring granular material from a first container to a second container, the latter being typically an applicator. The first container includes a neck and a base opposite to the former. The base includes through openings that cooperate with a cable passed therethrough for supporting the first container. A nozzle assembly includes an inlet removably connected to the neck and an outlet hat is selectively closed with a removable plug. A cover assembly is selectively and removably mounted to the first container covering the nozzle assembly. A flexible conduit is removably connected to the outlet, at one end, and the other end includes a regulating valve that is actuated from the outside. The other end is removably connected to the second container so that the transfer of the granular material can be accomplished without spillage and the contents are kept hermetically isolated from the outside.

5 Claims, 7 Drawing Sheets

CONTAINER AND COUPLING SYSTEM FOR TRANSFERRING GARANULAR AND OTHER MATERIALS

OTHER RELATED APPLICATIONS

The present application is a national stage patent application of the PCT/CR2002/000004, with international filing date of Jun. 6, 2002, which is hereby incorporated by reference.

BACKGROUND OF THE INVENTION

1. Field of the Invention

The present invention relates to a container and coupling system for transferring granular and other materials.

2. Description of the Related Art

Several designs for container and coupler system have been designed in the past. None of them, however, includes the features claimed herein.

Applicant believes that one of related references corresponds to U.S. Pat. No. 5,967,383 issued to the inventor in the present application, Edgar Hidalgo, on Oct. 19, 1999 for a container and coupler assembly for transferring granulated material. The patented coupling system includes a connecting threaded assembly that is frictionally and snugly mounted inside the neck of the container. The upper wall of the connecting threaded assembly includes at least one off-centered opening. The patented invention includes a cap assembly that is rotatably and coaxially mounted over the connecting threaded assembly and the former also includes at least one off-centered opening that is selectively made to coincide with the off-centered opening of the connecting threaded assembly. A spring is used to bias these two assemblies to make the respective off-centered openings not to coincide. A coupling ring assembly is firmly mounted inside the neck of a pump dispenser. The cap assembly engages the coupling ring assembly. A gasket member is used to achieve a hermetic sealing engagement between the dispenser and the container. A user can dispense granulated material from the container to a dispenser by achieving a hermetically sealed engagement without coming in contact with the material. However, it differs from the present invention because the patented invention required substantial modifications of the second container, which is typically an applicator used for fumigation, which has been obviated with the use of the flexible conduit, nozzle and cap assemblies of the present invention. Additionally, the use of a base that cooperates with a hanging cable facilitates the transportation of the first container in the field.

Applicant believes that another related reference corresponds to Costa Rica patent No. 2519 issued to the inventor of the present application, Edgar Hidalgo, in 1999 for a coupling system for pump and box for loading and unloading of granulated agrochemicals and others. This patented invention includes a valve, with two concentric cylindrical members and a collar-shape member. The valve is mounted to a container and the collar-shape member to another container. The collar-shape member receives and secures the valve and couples both containers so material can be transferred from one container to the other using the gravity force. However, there is no disclosure here of the nozzle, flexible conduit and cap assemblies, as mentioned above, nor of a base that cooperates with a cable for its support and transportation.

Applicant believes that other of related references corresponds to Costa Rica patent No. 2552 issued to the inventor of the present application, Edgar Hidalgo, in 1997 for an improvement to the above mentioned Costa Rica patent No. 2519. This patent incorporates to the parent patent a automatic closing mechanism, several packing assemblies to get an impermeable and hermetic closing of the system, a cover to protect the valve and several minor modifications to improve the system operation. However, this invention does not teach the use of a flexible conduit, nozzle, cap assemblies and the use of a base that cooperates with a hanging cable facilitates the transportation of the first container in the field, as in the present invention discloses.

Applicant believes that other of related references corresponds to Costa Rica utility model No. MU115 issued to the inventor of the present application, Edgar Hidalgo, in 1997 for a container for transferring, transporting and storage of granulated agrochemicals and others. This container is used with the system describes in the above mentioned Costa Rica patent numbers 2519 and 2552. This is ergonomic designed container to facilitate its handling while it provide and impermeable and hermetic closing system. However, the patented invention differs from the present invention for the same reasons discussed above.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a container and coupling system for safely storing and transporting granular materials.

It is another object of this invention to provide a container and coupling system that permit the safe transfer of granular materials to other containers.

It is still another object of the present invention to provide a spherical container and coupling system that is secure, hermetic and easy to manipulate.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
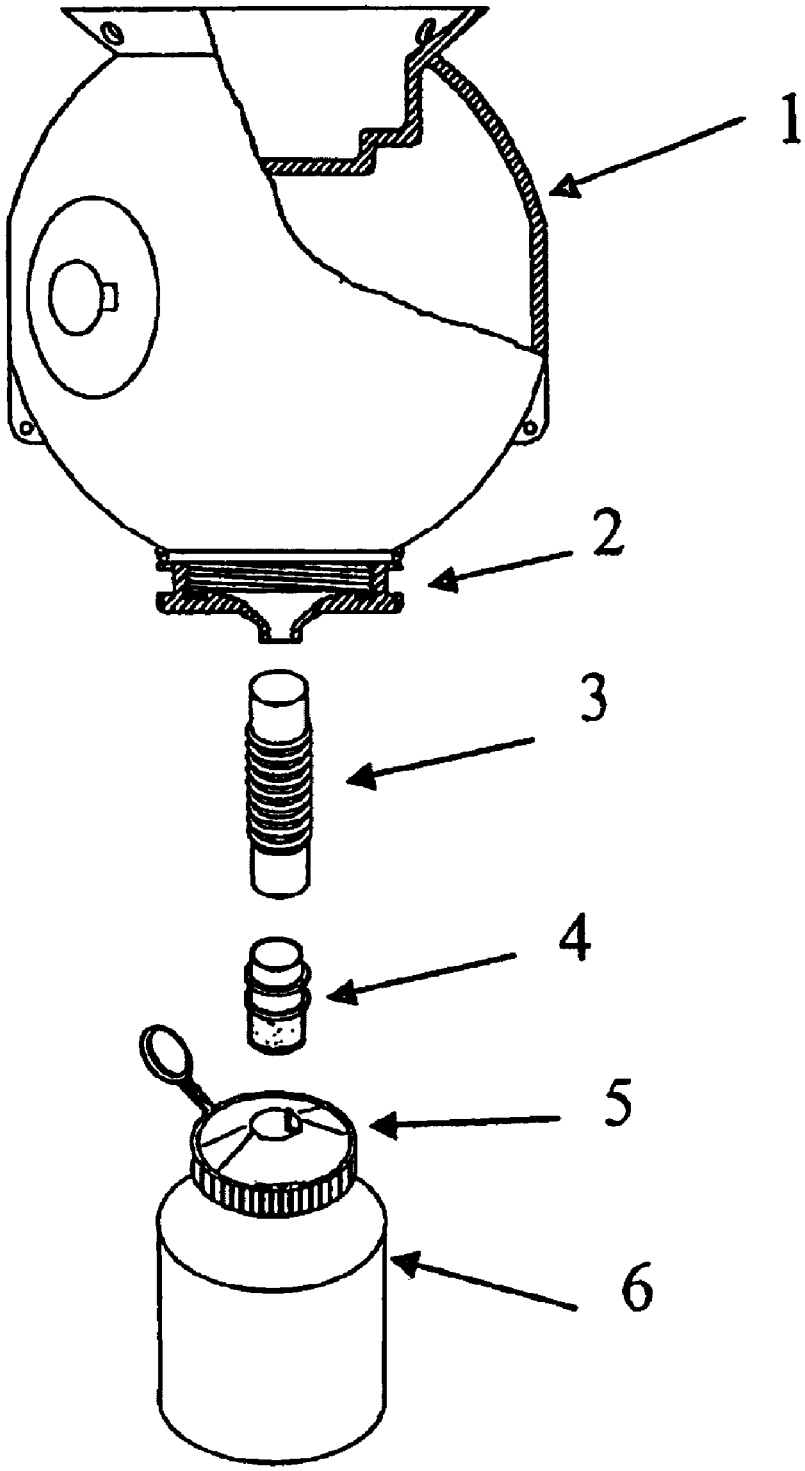
FIG. 1 represents a front elevational view of the preferred embodiment for the spherical container, object of the present application, with a partial cross section showing its inner upper configuration. Also the nozzle, the flexible conduit, the regulating valve, the cap and the second container are represented.

Referring now to the drawings, where the present invention is generally referred to with numeral 10, it can be observed that it basically includes spherical container assembly 1, nozzle assembly 2, flexible conduit assembly 3, regulating valve assembly 4, cap assembly 5 and container assembly 6, as seen in FIG. 1.

Figure 2:
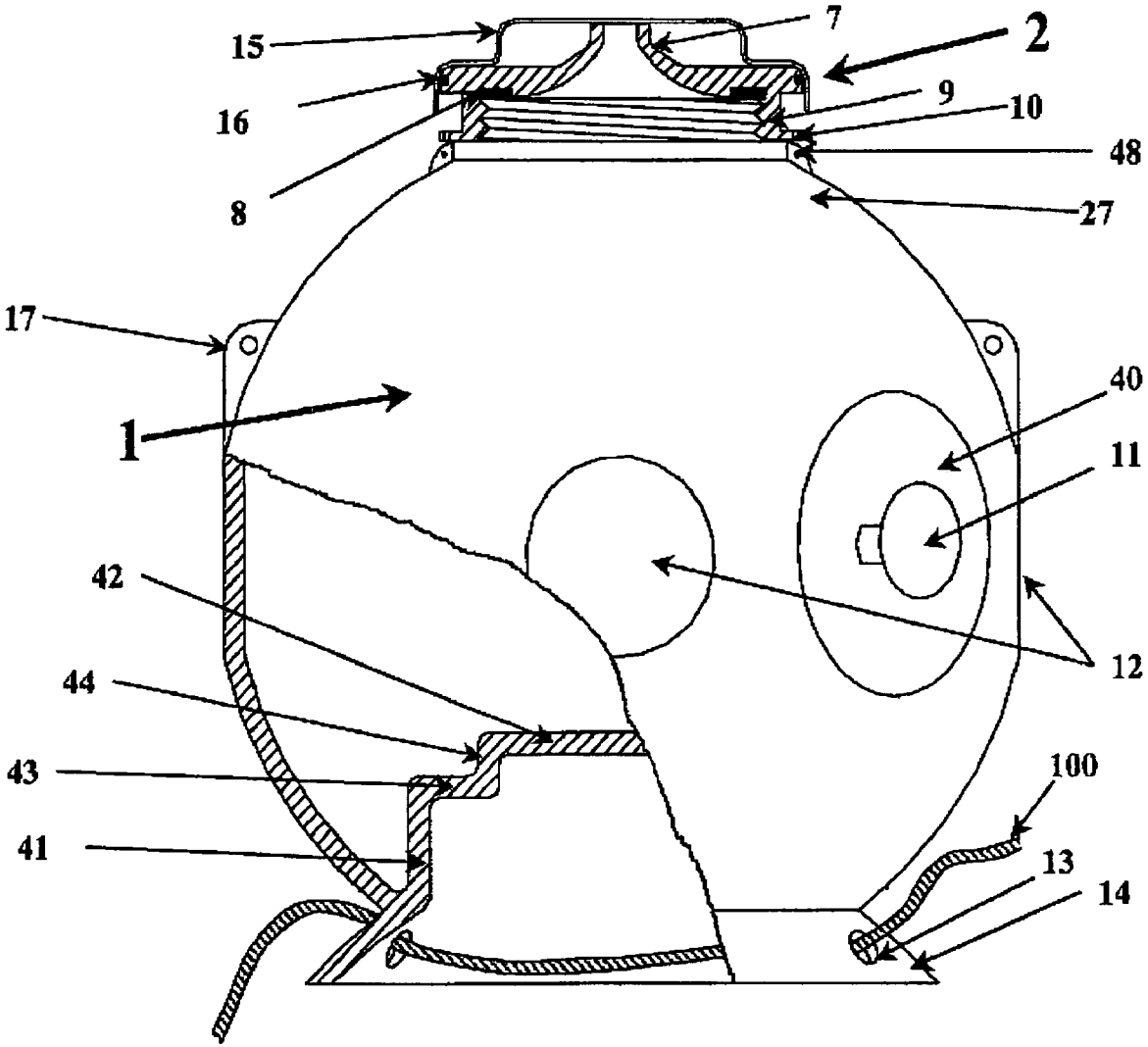
FIG. 2 shows a front elevational view of the spherical container with a partial cross section showing the interior of the lower portion of the spherical container.

Spherical container assembly 1 is used to store, transport and transfer granulated products to other containers 6 or vice versa. As best seen in FIG. 2, spherical container assembly 1 is a compact and hermetic container to provide safe and easy manipulation of its contents. The spherical configuration for container 1 is preferred, but also a conical or other suitable shape that permits the ready evacuation of the granular material can be used. Container assembly 1 has circular base 14 for stable upright support. Circular base 14 extends with a frustroconical shape and includes openings 13 for receiving therethrough cable 100. Step walls 41; 42; 43 and 44 are coaxially and annularly disposed inwardly from the center of base 14. Spherical container assembly 1 includes threaded neck 9. As seen in FIG. 2, bottom portion 19 includes circular base section 14 with through openings 13, internal horizontal sections 42 and 43 and inward vertical sections 41 and 44. Horizontal sections 42 and 43 and vertical sections 41 and 44 define internal cavity that cooperates with the shape of upper section 27 of container 1 and cap 15 when they are vertically stacked.

Two handle members 11 (only one is shown in FIG. 2) are cooperatively disposed on the outer surface of spherical container assembly 1, in one of the preferred embodiments. Depressions 40 are formed around handle members 11, undulations 40 and bottom portion 19. Handle members 11 diagonally opposed with respect to each other. Handle members 11 have, in the preferred embodiment, a mushroom shape and they are mounted to depressions 40 formed on the outer wall of container 1. The concave shape of depressions 40 permits the user to achieve a good grip with his/her hand.

Figure 6:
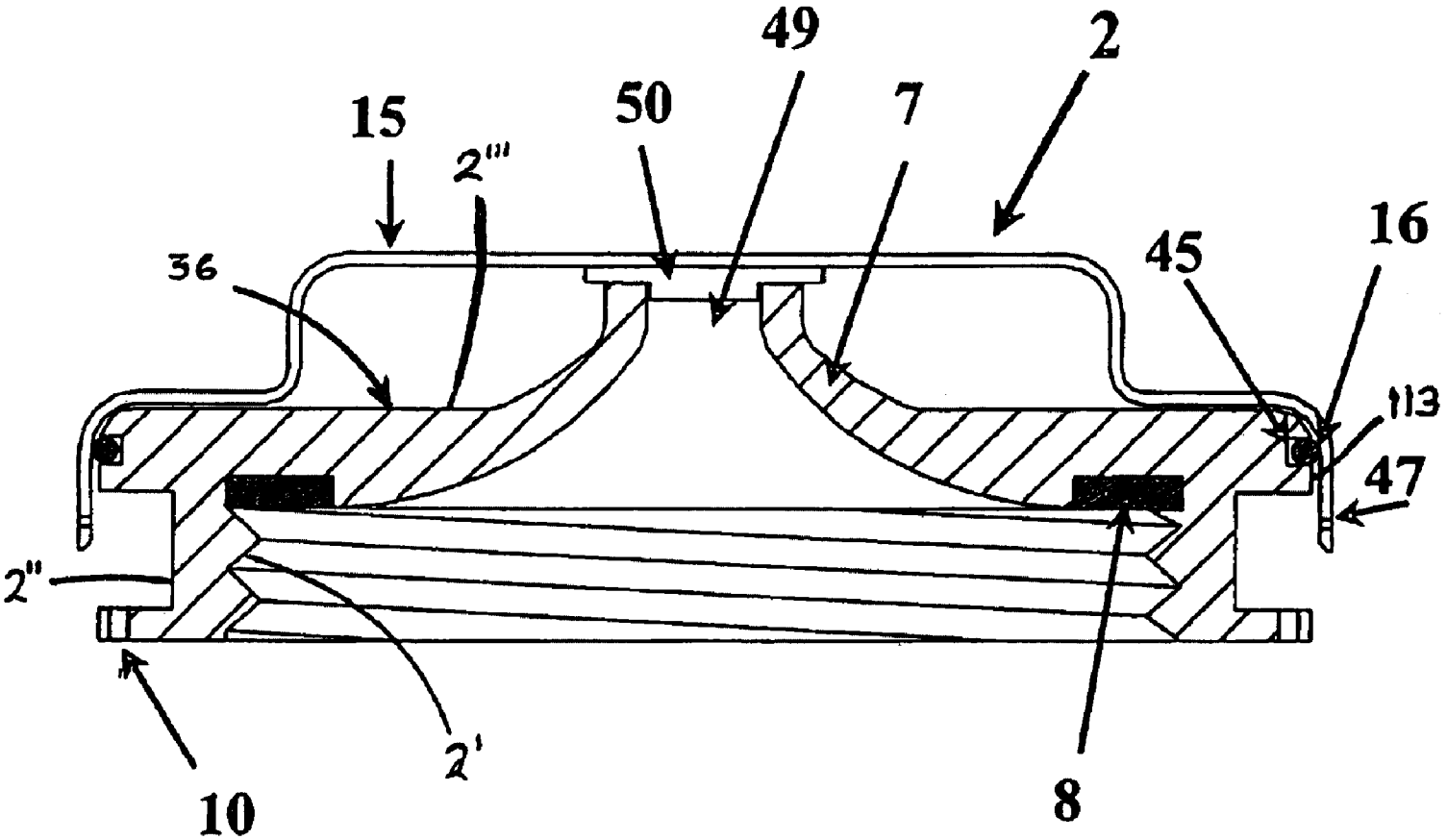
FIG. 6 is an enlarged cross-section elevational view showing the outlet nozzle, the cover, the O-ring and the plug.

As seen in FIG. 2, outlet nozzle assembly 2 includes transferring valve 36 and cover member 15. Transferring valve 36 has internal thread 2' that mates with threaded neck 9 to removably mount to each other. Transferring valve 36 also includes peripheral skirt 2" integrally built on top wall 2'" which includes central opening 49. Top wall 2'" has an underside with circular groove for receiving gasket 8 that coacts with the rim of threaded neck 9 to achieve a hermetic enclosure. Peripheral end 113 includes peripheral notch 45 that snugly receives O-ring 16 to further ensure the hermeticity and isolation of the granular material contained within container assembly 1. As best seen in FIG. 6, cover member 15 is rigid and snugly fits over peripheral end 113 that, along with plug member 50, keeps the contents of spherical container 1 hermetically sealed.

As best seen in FIG. 6, outlet nozzle assembly 2 has neck 7, end 36, internal threaded portion 19 and peripheral external cutout 12 for mounting any additional sealing element. Outlet nozzle assembly 2 also includes O-ring receiving peripheral notch 45 and through opening 10 adjacent to the lower portion of peripheral external cutout 12.

As seen in FIG. 6, gasket 8 is mounted on the top portion of threaded neck 9 to provide a hermetic sealing effect when outlet nozzle assembly 2 is cooperatively coupled to threaded neck 9. Plug 50 is removably mounted to opening 49 to ensure that the product is kept inside container assembly 1 when container 1 is stored or being moved. Finally, cover member 15 is removably mounted to outlet nozzle assembly 2. O-ring 16, mounted to O-ring receiving peripheral notch 45, keeps cover member 15 in place.

Figure 7:
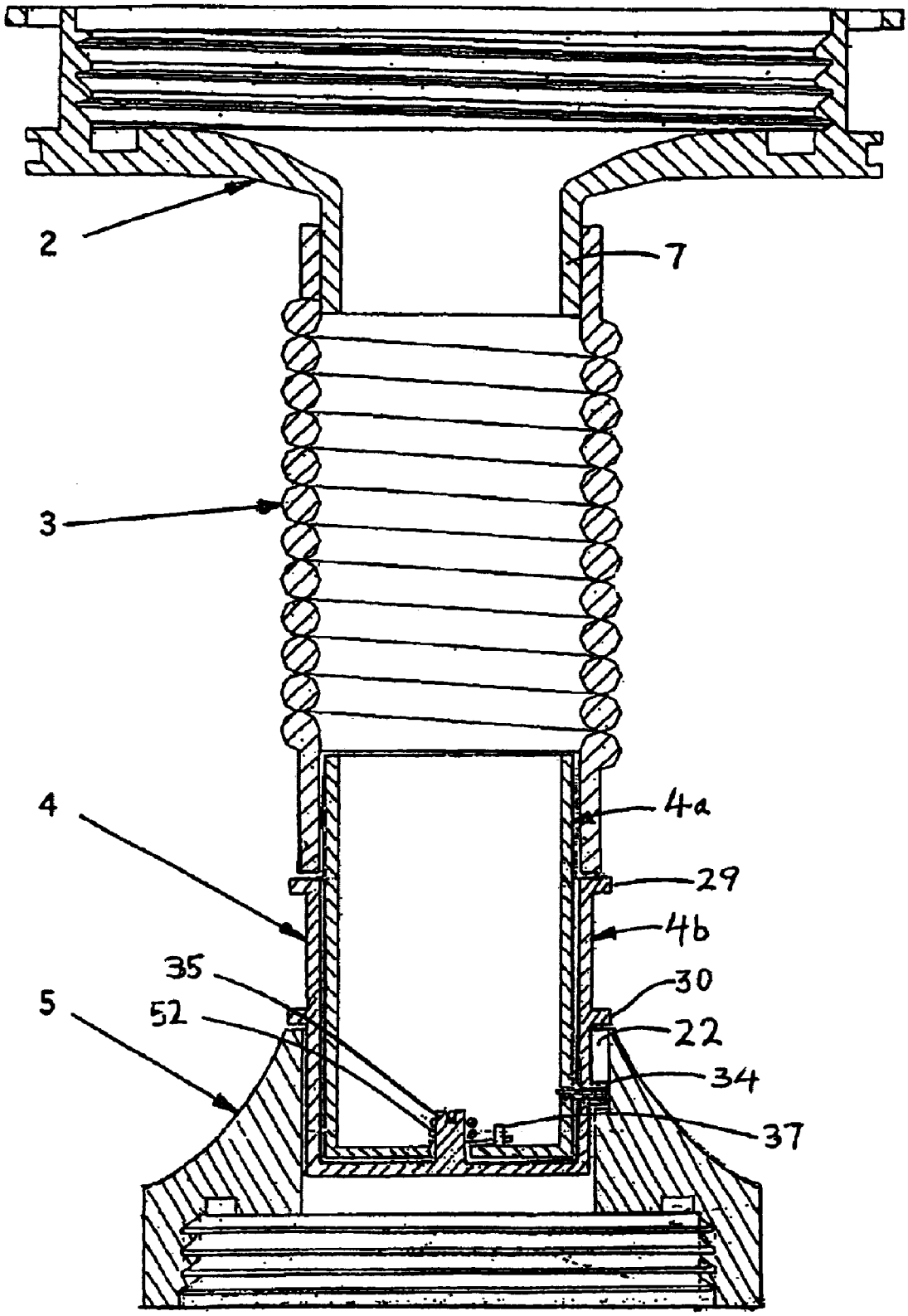
FIG. 7 is a cross-section elevational view showing the flexible conduit mounted to the nozzle at one end and the other end connected to the regulating valve and the cap.

As best seen in FIG. 7, flexible conduit 3 has two ends. One of the ends is removably connected to nozzle assembly 2 and the other end houses regulating valve assembly 3, which includes an inlet receiving the granular material entering from the end connected to nozzle assembly 2.

Figures 4A, 4B, 4C:
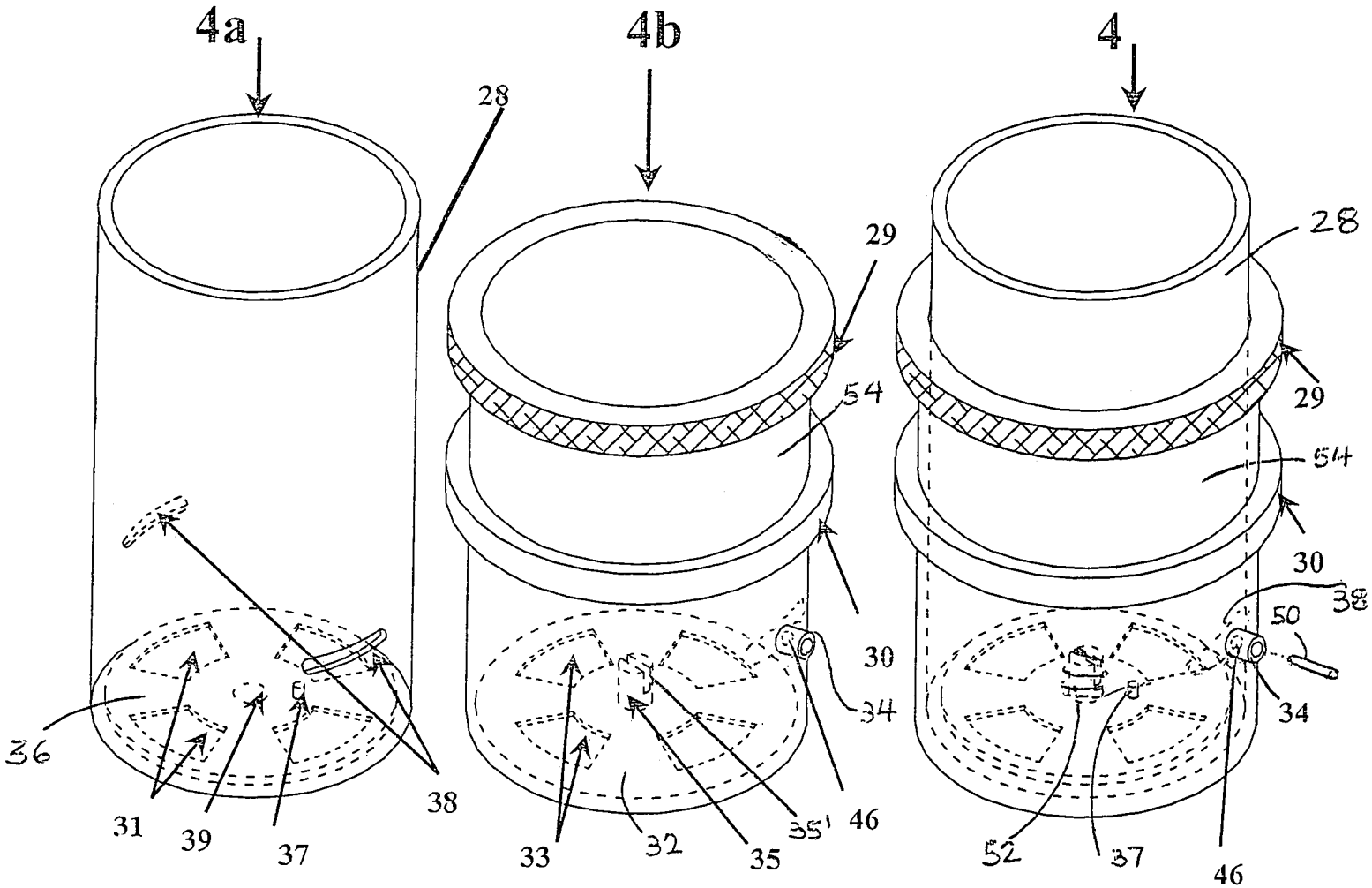
FIGS. 4A; 4B; 4C and 4D show isometric representations of alternated embodiments for the regulator valve.
Figure 5:
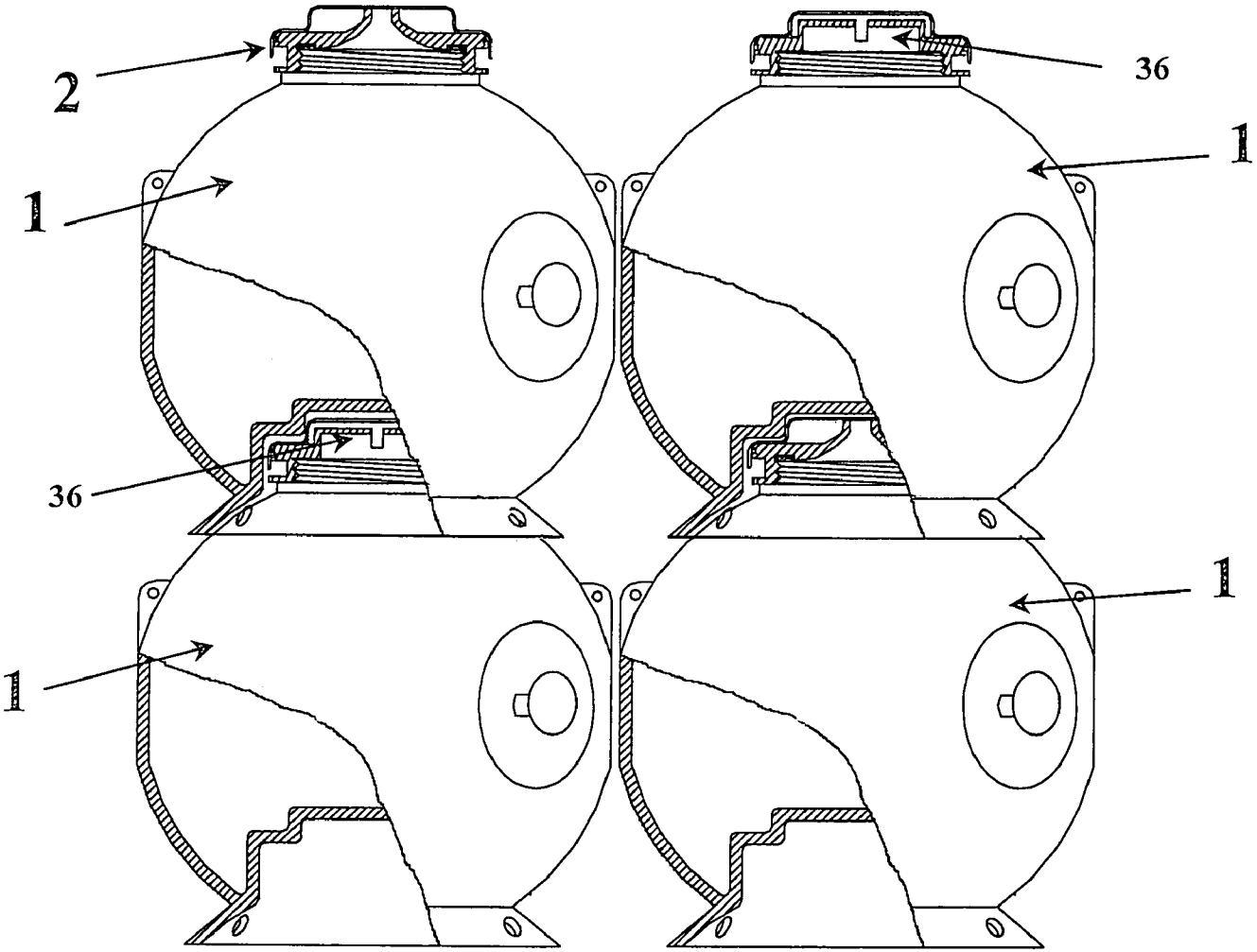
FIG. 5 shows a front elevational view of four stacked up spherical containers with their respective valves and including partial cross-sections to show the interlocking engagement.

As seen in FIGS. 4A; 4B and 4C, regulating valve assembly 4 includes cylinder 4*a* with bottom wall 36 that has through openings 31 and central opening 39, as best seen in FIG. 4A. Cylinder 4*a* also includes slots 38 on its lateral wall 28. Second cylinder 4*b* with bottom wall 32 has through openings 33 and inwardly and perpendicularly extending central cylindrical protrusion 35 with slot 35' at its top end, as best seen in FIG. 4B. Second cylinder 4*b* also has outwardly extending flanged edge 29 extending outwardly from the rim of lateral wall 54 and protruding annular wall 30 around the central portion of its lateral wall 54. Second cylinder 4*b* has tubular member 34 with central through opening 46. Once inserted cylinder 4*a* inside second cylinder 4*b*, as shown in FIG. 4C, pin 50 is passed through opening 46 and slot 38 to limit the movement of cylinder 4*a* inside second cylinder 4*b*. Also, one end of spring member 52 is inserted in slot 35' and the other end is engaged to pin 37. Through openings 31 and 33 can be made to coincide by aligning them, which is achieved by the application of a force of a predetermined magnitude to overcome spring member 52 that keeps them out of alignment and consequently in closed position, as best seen in FIG. 4C.

Figures 3A, 3B, 3C, 3D:
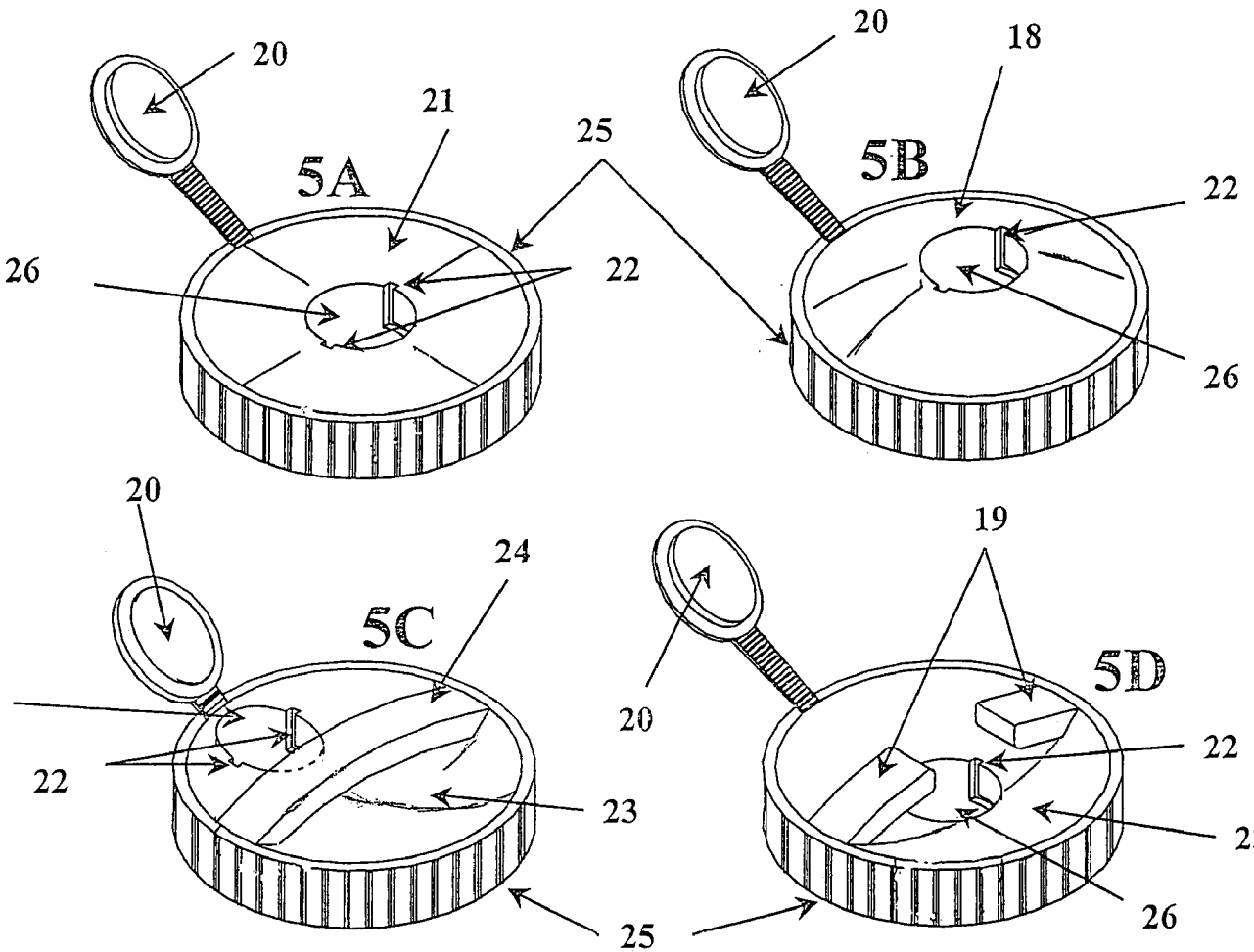
FIGS. 3A; 3B; 3C and 3D illustrate isometric views of four embodiments for the cap assembly removably mounted to the second container.

FIGS. 3A; 3B; 3C and 3D show four embodiments for cap assembly 5 removably mounted to container assembly 6. Embodiment 5A is represented in FIG. 3A and it has flat top wall 21 with central opening 26. Embodiment 5B is represented in FIG. 3B and it has convex top wall 18 with central opening 26. Embodiment 5C is represented in FIG. 3C and it has concave top wall 23 with eccentric opening 26 and arched handle 24; and he embodiment 5D represented in FIG. 3D has concave top wall 23 with central opening 26 and interrupted arched handle 19. Embodiments 5A; 5B; 5C and 5D also have plugs 20 to removably close openings 26. L-shape slots 22 adjacent to the top of openings 26 receives tubular member 34, as explained below.

As best shown in FIG. 7, to assemble container and coupling system 10 for transferring granular and other materials, a user inserts neck 7 of transferring valve 36 in one of the ends of flexible conduit assembly 3. The other end of flexible conduit assembly 3 is mounted to regulating valve assembly 4 until top with flanged edge 29. The other side of regulating valve assembly 4 is mounted inside opening 26 of cap assembly 5. Tubular member 34 is cooperatively inserted in L-shape slots 22 to lock regulating valve assembly with cap assembly 5.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A container and coupling system for transferring granulated materials, comprising:

A) first container means having first and second ends, opposite to each other, said first end defining a neck and said second end defining a base member that further includes at least one through opening and cable means cooperatively passing through said at least one through opening for supporting said first container means in an inverted position;

B) nozzle means sealingly and removably mounted to said first end, said nozzle means having a top wall with a perpendicularly extending peripheral skirt, said top member further including a raised tubular portion having a through aperture and the interior of said tubular portion having a substantially frustroconical shape to facilitate the evacuation of said granular material when said first container means is in said inverted position and said nozzle means is mounted thereto;

C) flexible conduit means having third and fourth ends, said third end cooperatively and removably receives said tubular raised portion;

D) regulating valve means having an inlet and an outlet, said inlet being removably connected to said fourth end for receiving the granular material that has entered through said third end and said outlet dispensing said granular material, and said valve regulating means further including actuating means that are actuated externally from said conduit means; and E) second container means including an opening connected to the interior of said second container means and removably receiving said outlet, and further having a cap assembly removably mounted to said second container means covering said opening.

2. The container and coupling system for transferring granulated materials set forth in claim 1, wherein said regulating valve means includes means for keeping said regulating valve means in closed disposition and selectively opened upon the application of a force of a predetermined magnitude to said actuating means.

3. The container set forth and coupling system for transferring granulated material set forth in claim 2 wherein said means for keeping said regulating valve means in the closed position includes a spring member.

4. The container set forth and coupling system for transferring granulated material set forth in claim 3 wherein said first container means has a substantially depressed area and further including handle means extending perpendicularly outwardly from said depressed area so that the manipulation of said fisrt container means is facilitated.

5. The container set forth and coupling system for transferring granulated material set forth in claim 4 wherein said first container means has a substantially spherical shape.

* * * * *